United States Patent [19]

Healy

[11] 4,426,064

[45] Jan. 17, 1984

[54] WINCH DRIVE MECHANISM

[75] Inventor: James W. Healy, Wakefield, Mass.

[73] Assignee: Superwinch, Inc., Putnam, Conn.

[21] Appl. No.: 247,288

[22] Filed: Mar. 25, 1981

[51] Int. Cl.[3] ..... B66D 1/14; B66D 1/20; B66D 1/22; B66D 3/16

[52] U.S. Cl. ..... 254/342; 254/358; 74/804

[58] Field of Search ..... 254/342, 344, 356, 358, 254/362; 188/72.2, 72.8, 134; 74/802, 803, 804

[56] References Cited

U.S. PATENT DOCUMENTS

| | | | |
|---|---|---|---|
| 2,170,951 | 8/1939 | Perry | 74/804 |
| 2,354,387 | 7/1944 | Lawler | 254/342 |
| 3,561,292 | 2/1971 | Lorence | 74/804 |
| 3,738,614 | 6/1973 | Peterson | 254/358 |
| 3,965,774 | 6/1976 | Omi et al. | 74/805 |
| 4,033,552 | 7/1977 | Kuzarov | 254/342 |

FOREIGN PATENT DOCUMENTS

| | | | |
|---|---|---|---|
| 816737 | 10/1951 | Fed. Rep. of Germany | 254/342 |

*Primary Examiner*—Billy S. Taylor
*Attorney, Agent, or Firm*—Hayes & Reinsmith

[57] ABSTRACT

A compact and rugged drive mechanism for a winch of high pull rating is disclosed featuring a cycloid drive of powerful construction which serves to provide a driving connection between a cable drum and a reversible motor driven, two stage chain and sprocket drive to an input drive shaft. The cycloid drive includes a ring gear and cycloid gear in meshing engagement with the ring gear. The cycloid gear is supported for eccentric rotation within the ring gear. A clutch pin is releasably secured in fixed relation to the ring gear and a fixed housing to prevent ring gear rotation during normal power-in and power-out modes of operation under cable load. Controlled free spooling of the drive mechanism is effected, when desired, upon removing the clutch pin to render it inoperative.

8 Claims, 13 Drawing Figures

WINCH DRIVE MECHANISM

FIELD OF THE INVENTION

This invention generally related to winches and particularly concerns drive mechanisms of high pull rating for winches suited to be mounted, for example, on off road vehicles and which possess significant power capability.

OBJECTS OF THE INVENTION

A primary object of this invention is to provide a new and improved winch drive mechanism which features a single stage speed change reducer drivingly connected between an input drive to the speed reducer and a cable drum and which is particularly designed to ensure continuous cable control during winching operations.

Another object of this invention is to provide a new and improved winch drive mechanism of the type described which is uniquely designed to effect not only significant savings of space in a compact rugged construction but also a particularly high mechanical efficiency and power capability with minimized weight penalties and which is suited for relatively low cost manufacture and assembly in relation to its high power capability.

A further object of this invention is to provide such a winch drive mechanism capable of sustained high performance under demanding conditions over extended periods of time with minimum service requirements.

Other objects will be in part obvious and in part pointed out in more detail hereinafter.

A better understanding of the objects, advantages, features, properties and relations of the invention will be obtained from the following detailed description and accompanying drawings which set forth an illustrative embodiment and are indicative of the way in which the principle of the invention is employed.

DESCRIPTION OF A PREFERRED EMBODIMENT

Figure 1:
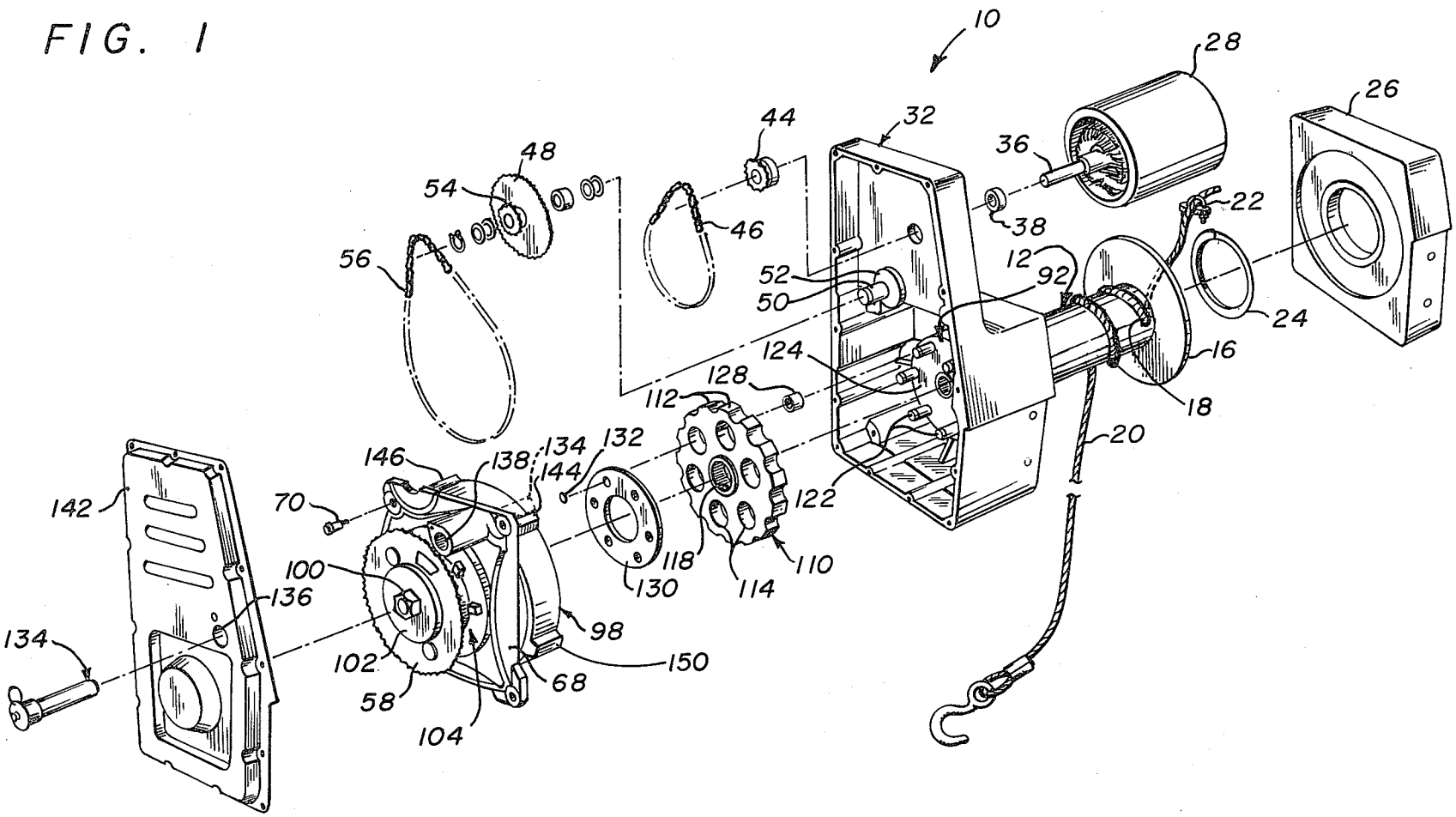
FIG. 1 is an exploded isometric view of a winch of this invention showing principal parts in relative relation to one another.

Referring to the drawings in detail, a winch 10 is shown (FIGS. 1 and 2) having a cable drum 12 with enlarged end flanges 14, 16 and a hole 18 in the drum surface through which an end of a cable 20 is fed into the drum interior wherein the cable end is secured by a suitable clamp 22 fixed to the cable end. A sleeve bearing 24 is received in an outboard housing 26 for supporting an outboard end of the drum 12 for rotation. The outboard housing 26 has suitable solenoids, not shown, mounted therein for controlling forward and reverse operation of a reversible direct current (DC) type motor 28 by a hand operated reversing switch, not shown, which activates the solenoids.

Suitable electrical connections, not shown, are provided to the solenoids, winch motor 28 and a power source, not shown, such as a vehicle DC storage battery source. The electrical connections and wire hook-up are of a type suitable for controlling forward and reverse operation of the winch drive motor 28. Motor 28 is secured by fasteners such as that shown at 30 in FIG. 2 to a main frame or housing 32. A protective motor cover 34 is also releasably secured to a mounting bracket, not shown, which mounting bracket in turn is also secured to main housing 32.

A motor output drive shaft 36 is supported in permanently lubricated antifriction bearings 38 in an upper portion of housing 32 for rotation about an axis parallel to the cable drum axis. A projecting end of motor output drive shaft 36 is connected by a double stage, chain and sprocket speed reducer 40 to a drive connection or primary speed reducer 42 to cable drum 12. A sprocket assembly 44 is keyed to motor shaft 36; sprocket chain 46 drivingly connects the motor shaft sprocket assembly 44 to a larger sprocket 48 secured on an idler shaft 50 supported for rotation about an axis parallel to the cable drum axis in needle bearings 52 in housing 32; idler shaft 50 has a second, smaller sprocket 54 fixed to sprocket 48 which drives chain 56 connected to a larger rotary input drive or drive sprocket 58 supported for rotation in coaxially aligned relation to cable drum 12 on a cable drum drive shaft 60 rotatably supported by a permanently lubricated ball bearing assembly 62 packed for normal use and mounted in coaxial alignment with drum 12 in a central opening 64 of a hub 66 of a fixed member or anchor plate 68 of the housing 32 secured thereto by fasteners such as that shown at 70 (FIG. 1).

Rotatably supported on a hub bearing surface 72 of anchor plate 68 is a ring gear 98 which engages an outboard face of anchor plate 68 and is restrained against axial displacement by a retaining ring 76 fixed on the periphery of anchor plate hub 66. To restrain cable drum drive shaft 60 against undesired axial displacement, the outer and inner races 78 and 80 of bearing assembly 62 may be press fit, respectively, against an inside wall 82 of central hub opening of anchor plate 68 and an enlarged intermediate section 84 of drive shaft 60 with the outer bearing race 78 abutting an annular shoulder 86 on anchor plate 68. A reduced end of drive shaft 60 is rotatably supported in a lubricated needle-bearing assembly 88 mounted within a central opening 90 of a cycloid drive hub 92, which in turn is supported in coaxial alignment with drum 12 for rotation within housing 32 by a permanently lubricated antifriction ball bearing assembly 94. The latter is suitably packed and mounted within a central opening 96 on an outboard end of housing 32 and is secured therein by any suitable means such as the illustrated retaining ring 97. An opposite projecting end of drive shaft 60 is shown having a hex nut 100 threadably secured thereon and maintaining an input drive support or flat retaining washer 102 in engagement with drive sprocket 58 in abutment against a brake assembly 104.

Primary speed reducer 42 of the cable drum drive is provided in a significantly compact cycloid drive of high strength construction capable of achieving gear speed reduction with excellent mechanical efficiency for high pull rating of winch 10 and overall concommitant manufacturing cost reductions. In the illustrated cycloid drive, ring gear 98 is preferably formed with sixteen (16) internal gear segment teeth such as at 108. A cycloid gear 110 is mounted within ring gear 98 and has an outside circumference substantially equal to the inside circumference of ring gear 98 less one tooth pitch. Cycloid gear 110 is formed with fifteen (15) external gear segment teeth such as at 112 to effect maximum gear speed reduction by providing only one cycloid gear tooth pitch less than the total number of ring gear teeth.

Cycloid gear 110 has six equally spaced drive pin holes 114 in surrounding symmetrical relation to a central opening 116 of cycloid gear 110 within which a needle bearing assembly 118 is mounted for supporting cycloid gear 110 on a cam section or eccentric 120 keyed to drive shaft 60. Six drive pins 122, corresponding to the six cycloid gear holes 114, are press fit into a radial flange section 124 of drive hub 92.

A roller 128 (FIGS. 1 and 2) is rotatably supported on each drive pin 122 for engaging cycloid gear 110, and each roller 128 is maintained in its corresponding cycloid gear hole 114 between hub flange 124 and an apertured support ring 130 fitted over projecting ends of drive pins 122. Support ring 130 is maintained in engagement with the cycloid drive gear 110 by any suitable means such as a retaining ring 132 fitted into a groove, not shown, circumferentially extending about the exposed end of each drive pin 122.

Figure 3:
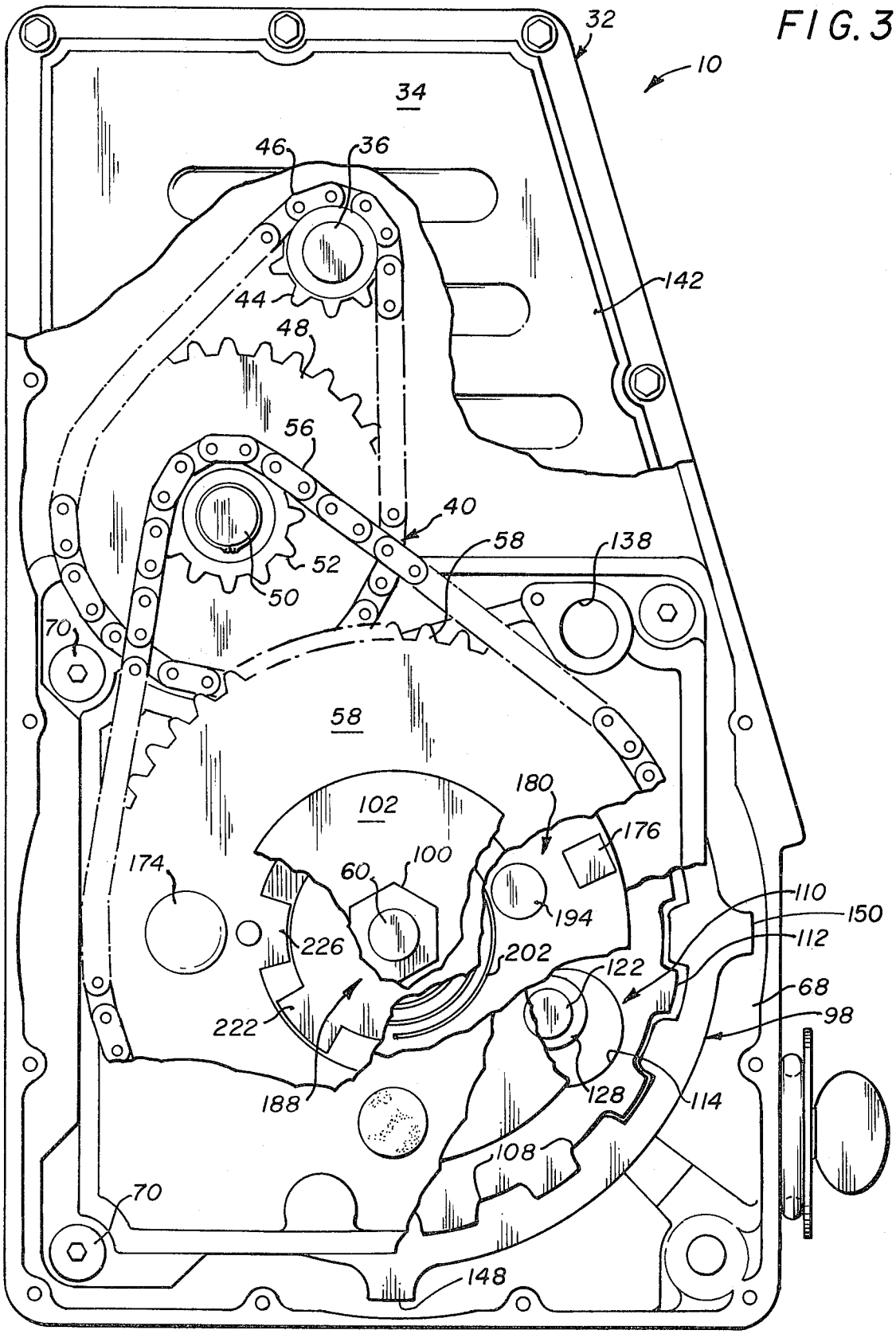
FIG. 3 is an enlarged side view, partly broken away, illustrating certain of the components shown in FIG. 2.
Figure 4:
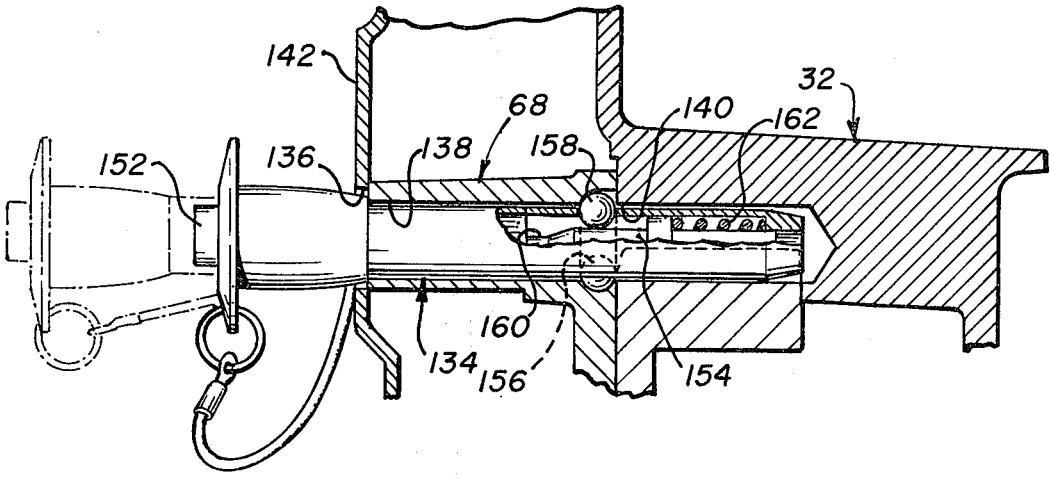
FIG. 4 is a section view, partly broken away, of a lock pin employed in the winch drive mechanism.

Under normal operating conditions, ring gear 98 is maintained stationary by a clutch or lock pin 134 best seen in FIGS. 1 and 4 extending through registering openings 136, 138 and 140 in housing end cover 142, anchor plate 68 and housing 32 with an inner end of lock pin 134 projecting through anchor plate 68 for engagement with a confronting side wall of any one of lobes 144, 146, 148, 150 radially projecting from ring gear 98 (FIGS. 1 and 3).

The lobes of ring gear 98 are spaced apart and four such lobes may be provided, as shown, equally circumferentially spaced about ring gear 98 whereby ring gear rotation is permitted, with lock pin 134 engaged, to an extent determined by the spacing between side walls of adjacent lobe pairs confronting lock pin 34 located therebetween in its locked position as illustrated in FIG. 4.

As shown, lock pin 134 preferably has an exposed push button 152 on an end of an actuating rod 154 which in its illustrated full line position normally urges a pair of ball detents 156, 158 through suitable openings in pin 134 (the openings being of slightly smaller diameter than ball detents 156, 158) into locking engagement with adjacent surrounding surfaces of anchor plate 68 and housing 32. A reduced diameter section 160 of actuating rod 154 may be moved into a detent receiving position upon depressing actuating rod push button 152 against a biasing force of a spring 162 whereupon ball detents 156, 158 may be moved radially inwardly within the confines of pin 134 to permit its withdrawal, when desired, to allow ring gear rotation relative to anchor plate 68 and housing 32.

With ring gear 98 stationary due to its engagement with lock pin 134, when drive shaft eccentric 120 rotates as viewed in FIGS. 5–8, the cycloid needle bearing 118 and cycloid drive gear 110 fixed to needle bearing 118 revolve in the opposite angular direction around drive pins 122 of hub 124 in an eccentric motion with the external gear teeth 112 of the cycloid drive gear 110 consecutively meshing with the internal gear teeth 108 on ring gear 98.

Figure 5:
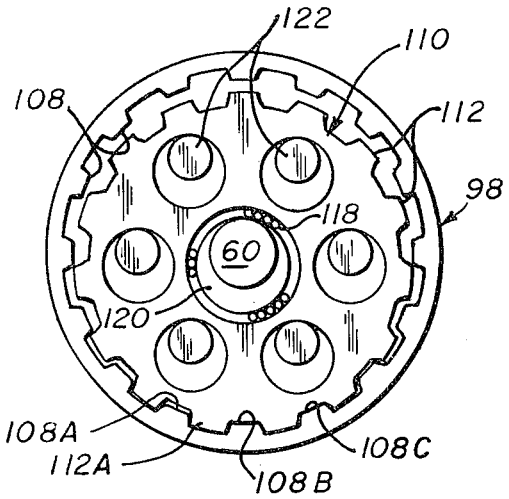
FIGS. 5, 6, 7, and 8 are schematic views of a cycloid gear drive component employed in the winch drive mechanism and showing consecutive views of meshing gears at 120 degree intervals during clockwise rotation of a drive shaft eccentric from a starting position (FIG. 5) into a corresponding position (FIG. 8) after the drive shaft eccentric has rotated one revolution.

More specifically, a starting position is illustrated in FIG. 5 wherein external gear segment tooth 112A of cycloid drive gear 110 is in mesh with ring gear 98 between its teeth 108A and 108B. FIGS. 5–8 will be understood to be viewed axially from the cable drum side of the winch.

Figure 6:
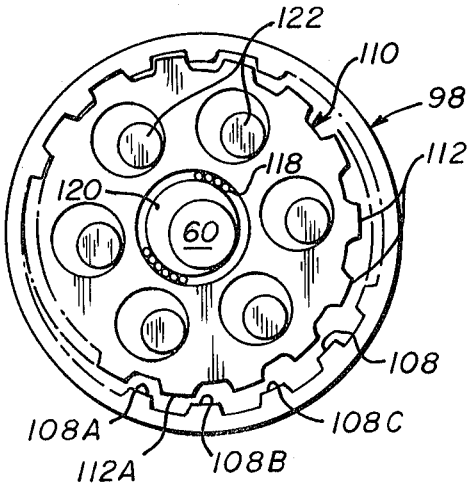
Figure 7:
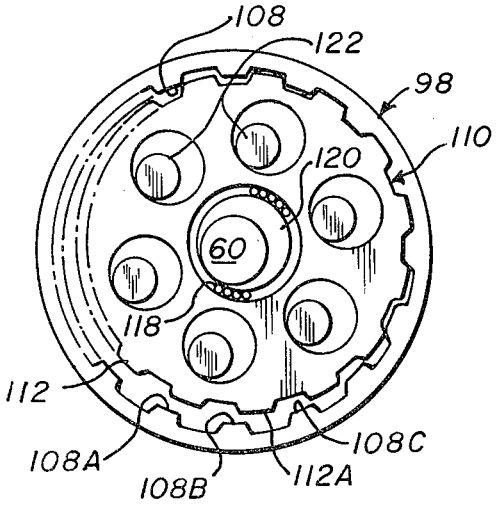
Figure 8:
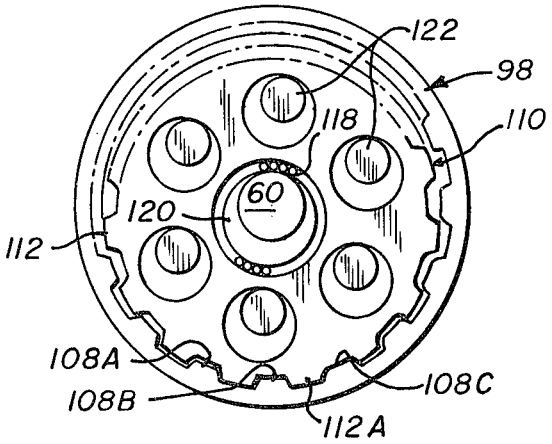
Figure 9:
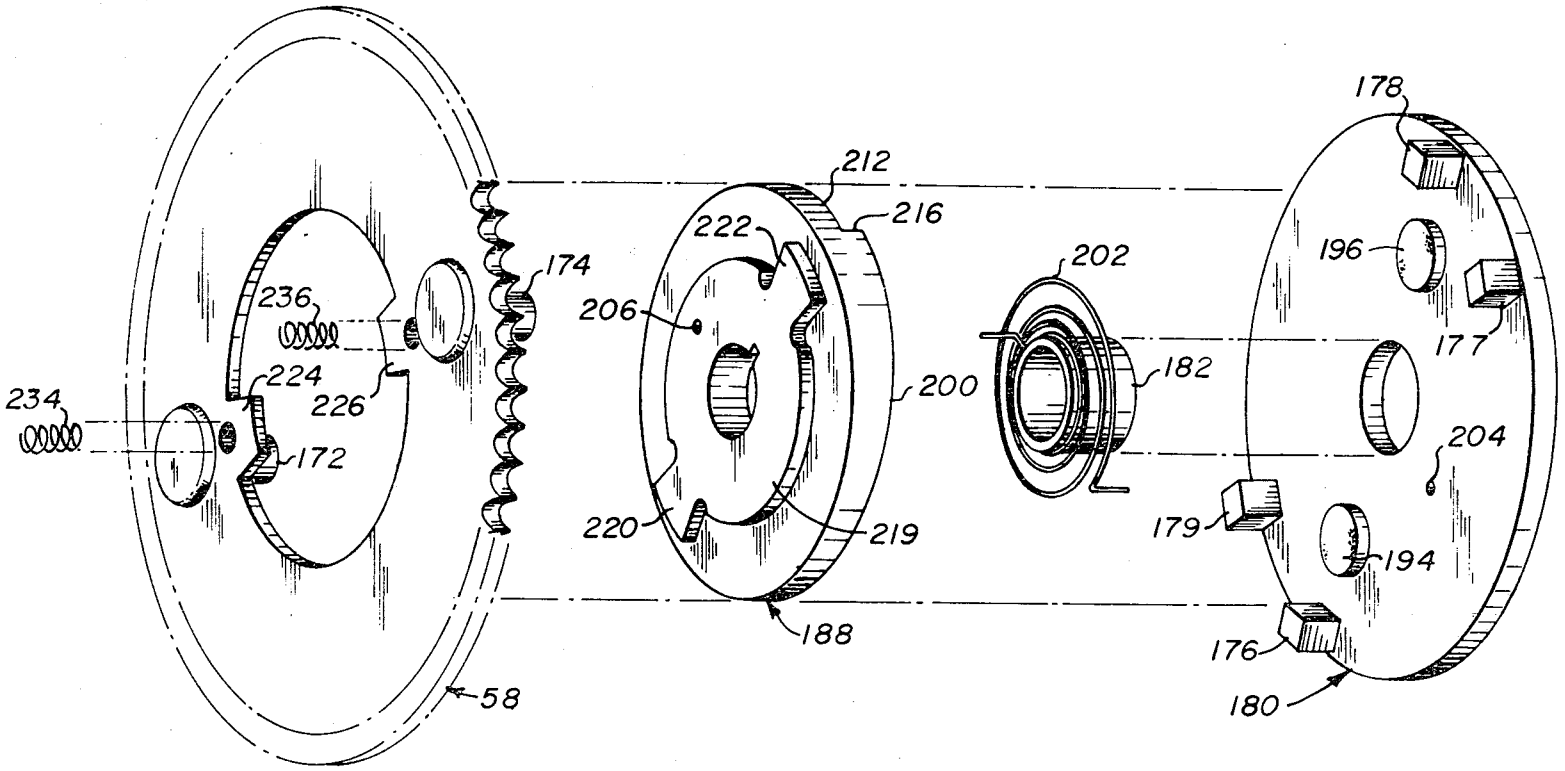
FIG. 9 is an enlarged, isometric exploded view showing components of the winch brake assembly.

Upon 120 degree clockwise rotation of drive shaft eccentric 120 from start position (FIG. 5) into the position shown in FIG. 6, cycloid drive gear tooth 112A is raised out of mesh and initiates a counterclockwise movement as viewed in the drawings responsive to continued clockwise rotation of drive shaft eccentric 120. Cycloid drive gear 110 continues its counterclockwise movement as shown, for example, in FIG. 7 which depicts 240 degree clockwise rotation of drive shaft eccentric 120 from its start position of FIG. 5. Upon completion of one revolution of drive shaft eccentric 120 in a clockwise direction (FIG. 8), and with ring gear 98 stationary, cycloid drive gear 110 will have rotated in a counterclockwise direction to establish meshing engagement of cycloid drive gear tooth 112A with adjacent ring gear teeth 108B and 108C, which is one gear tooth behind the starting position (FIG. 5) of cycloid gear tooth 112A as a result of the one tooth difference between the total number of cycloid drive gear teeth 112 and ring gear teeth 108.

Such angular movement of cycloid drive gear 110 is transmitted to cycloid drive hub 92 through hub drive pins 122 and to cable drum 12 by a suitable mechanical expandible fastening pin such as shown at 164. Pin 164 diametrically extends through a reduced diameter outboard end 92A of drive hub 92 and into diametrically opposed aligned openings 166, 166 in a drum support sleeve 168, surrounding the reduced end 92A of drive hub 92, and into openings 170, 170 of cable drum 12 which is press fit over the drum support sleeve 168 for rotation with drive hub 92.

By virtue of the above described single stage, compact cycloid drive, the gear speed reduction effected is a 15:1 reduction in the illustrated embodiment. Rotation of the drive shaft 60 and its eccentric 120 results in a rotary movement transmitted by the cycloid drive to cable drum 12 in an angular direction opposite the input rotation of the drive shaft 60.

Accordingly, cable drum 12 (as viewed axially from outside its drive sprocket 58, FIG. 1) rotates clockwise when drive sprocket 58 rotates counterclockwise. With cable 20 secured and wound counterclockwise from its secured drum end as shown in FIG. 1 about its drum 12, again as viewed axially from outside drive sprocket 58 (FIG. 1), a counterclockwise movement of drive sprocket 58 and drive shaft eccentric 120 effects clockwise rotation of cable drum 12 in a "winch-in" or "power-in" mode of operation. Angular movement of drive sprocket 58 and drive shaft eccentric 120 in an opposite clockwise direction causes cable drum rotation in a counterclockwise direction to effect a "winch-out" or "power-out" mode of operation.

To effect a continuously and uniformly controlled power drive to cable drum 12 wherein cable 20 and its load under all conditions is under control, even in a most unlikely event of failure, for example, in the sprocket drive train, the brake assembly 104 incoporates a plurality of unique features within a compact, rugged envelope particularly suited for easily and readily controlled field winch applications. Drive sprocket 58 carries a pair of diametrically opposed pins 172, 174 (FIGS. 9–13) respectively engageable with first and second pairs of studs 176, 177 and 178, 179 fixed to and projecting from a confronting surface of a brake disc 180 rotatably supported in coaxially aligned relation (FIG. 2) with drive sprocket 58 and cable drum 12 on a bushing 182 mounted on drive shaft 60 between a flat washer 184, engaged with inner race 80 of bearing assembly 62, and a spring retaining washer 186. Flat washer 184 and spring retaining washer 186 are coaxially supported on drive shaft 60 with spring retaining washer 186 disposed between bushing 182 and a first brake member or brake cam 188. The latter in turn is sandwiched between drive sprocket 58 and second brake member or brake disc 180 with brake cam 188 secured by suitable means such as key 190 to drive shaft 60.

Figure 2:
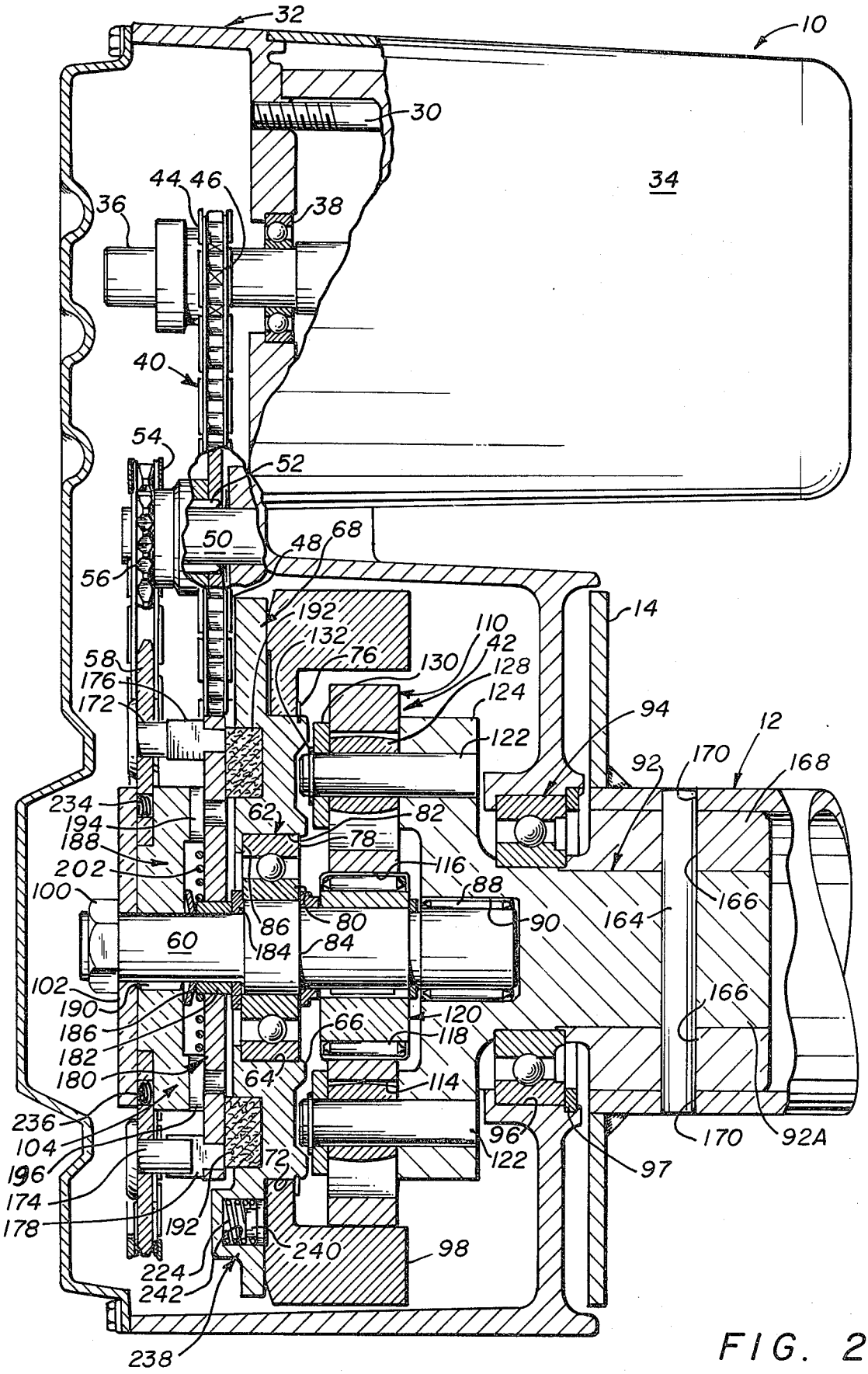
FIG. 2 is an enlarged front elevation view, partly in section and partly broken away, showing certain components of a drive and brake mechanism of the winch of FIG. 1.

Drive sprocket 58 and brake disc 180 are rotatable relative to drive shaft 60; brake disc 180 is movable axially, relative to drive shaft 60, toward and away from anchor plate 68 shown in FIG. 2 as having brake pads 192 formed of suitable material to effect high frictional resistance to movement of brake disc 180 relative to anchor plate 68. Anchor plate 68 is provided with a plurality, preferably six, equally spaced symmetrically disposed brake pads 192 in surrounding relation to the central opening of anchor plate 68.

To positively lock drive shaft 60 and thereby cable drum 12 in brake engaged position against rotation, brake cam rotation is arrested by predetermined relative angular movement of brake cam 188 and brake disc 180. Such relative angular movement of members 180 and 188 axially displaces brake disc 180 into engagement (FIG. 2) with anchor plate brake pads 192, and pressure pins 194, 196 of brake disc 180 are pressed into positive engagement against confronting inclined cam ramp surfaces 198, 200 (best seen in FIGS. 11 and 13) of brake cam 188 to lock brake disc 180 against rotation and prevent angular movement of drive shaft 60 to which brake cam 188 is keyed. Effective brake action requires the resistance of brake pads 192 to relative angular movement of brake disc 180 to exceed that effected between the brake cam 188 and disc pressure pins 194, 196.

More specifically, a brake torsion spring 202 (best seen in FIG. 9), having its opposite ends secured in holes 204 and 206 in brake disc 180 and brake cam 188, respectively, and wound about bushing 182, serves to urge brake disc 180 in a counterclockwise direction as viewed axially from outside the drive sprocket 58 (FIG. 1). Brake disc pressure pins 194, 196 are accordingly respectively urged toward raised or "high ramp" ends 208, 210 of cam surfaces 198, 200 of brake cam 188 (best seen in FIGS. 11 and 13). Pressure pins 194, 196 of brake disc 180 are diametrically opposed and at equal radial distance from the central brake disc axis to respectively project toward brake cam 188 and engage its two ramp surfaces 198, 200. The two cam ramp surfaces 198, 200 are formed about the perimeter of the brake cam 188. Each surface 198 and 200 is inclined upwardly from its low ramp end 212 and 214, respectively, adjacent shoulders 216 and 218. The latter define the termination of the high ramp end 210 and 208 of adjacent cam surfaces 200 and 198, each of which extend arcuately from its respective low ramp end 214 and 212 toward its respective high ramp end 210 and 208.

The side of brake cam 188 opposite its profiled cam surfaces features an embossed center drive portion 219 (best seen in FIG. 9) having diametrically opposed, radially outwardly projecting external lugs 220, 222 engageable with complementary radially inwardly projecting drive lugs 224, 226 (FIGS. 10 and 12) on drive sprocket 58.

Figure 10:
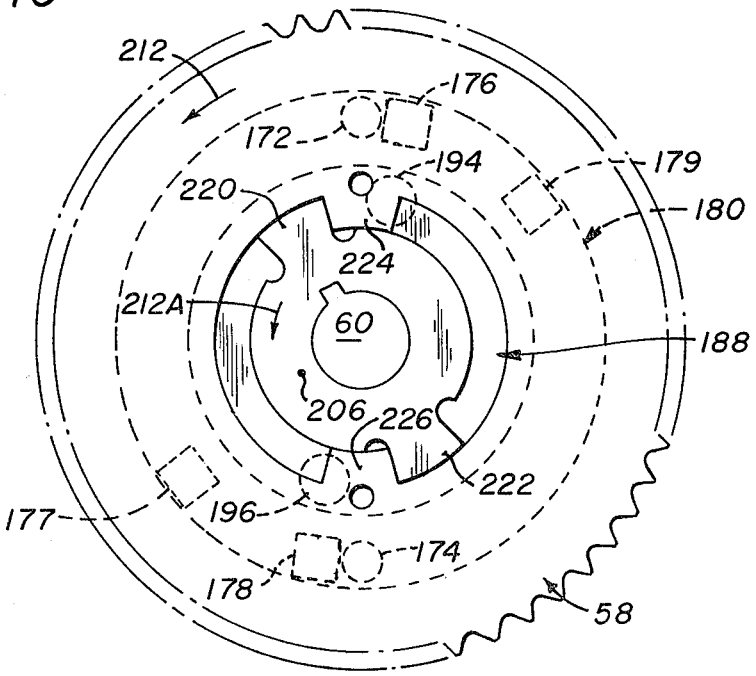
FIG. 10 is an enlarged schematic view showing the relative relation of certain brake components of FIG. 9 with those components positioned in a brake loaded condition.
Figure 11:
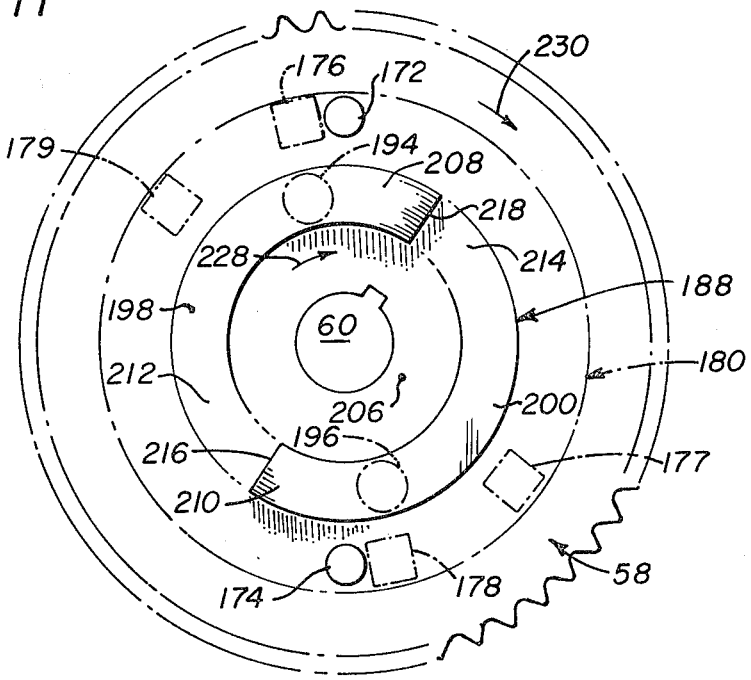
FIG. 11 is a view of the components of FIG. 10 in a position identical to FIG. 10 but showing the reverse side of those components.

Operation of brake assembly 104 is shown in FIGS. 10–13 with lock pin 134 engaged. FIGS. 10 and 11 show the same position of brake assembly 104, i.e., a brake loaded or engaged, starting position for a cable loaded power-in mode of winch operation. FIG. 10 is viewed axially from outside drive sprocket 58 (FIG. 1); the identical brake components of FIG. 10 are shown in the same position in FIG. 11 but are viewed in reverse, i.e., axially from the cable drum side (FIG. 1).

With the brake engaged and a static load on cable 20, the drum 12 and the cycloid drive 42 are urged counterclockwise as viewed from drive sprocket 58 about the stationary drive shaft eccentric 120. Lock pin 134 accordingly is engaged by a right hand lobe 144 of ring gear 98 (as shown in FIG. 1) of a ring gear lobe pair such as 144, 146 between which lock pin 134 is fixed in operating position.

Assuming motor 28 is then energized to rotate its output shaft 36 counterclockwise in a "power-in" mode, drive chains 46 and 56 effect a corresponding counterclockwise movement to drive sprocket 58 as indicated by arrow 212 in FIG. 10. A first lost motion drive, comprising internal lugs 224, 226 on drive sprocket 58 and external brake cam lugs 220, 222, is engaged to rotate brake cam 188, drive shaft 60 and its eccentric 120 in a corresponding counterclockwise direction as shown in FIG. 10 by arrows 212, 212A viewed axially from outside the drive sprocket 58 to drive cable drum 12 clockwise via cycloid drive 42 as above described.

In the "power-in" mode, initial counterclockwise rotation of drive shaft eccentric 120 drives both cycloid gear 110 and ring gear 98 clockwise (FIG. 1) to engage lock pin 134 by left hand lobe 146 of the lobe pair 144, 146 between which lock pin 134 is fixed to thereby fix ring gear 98 relative to cycloid gear 110 for its subsequent clockwise cable drum driving rotation during the cable power-in mode.

Figure 12:
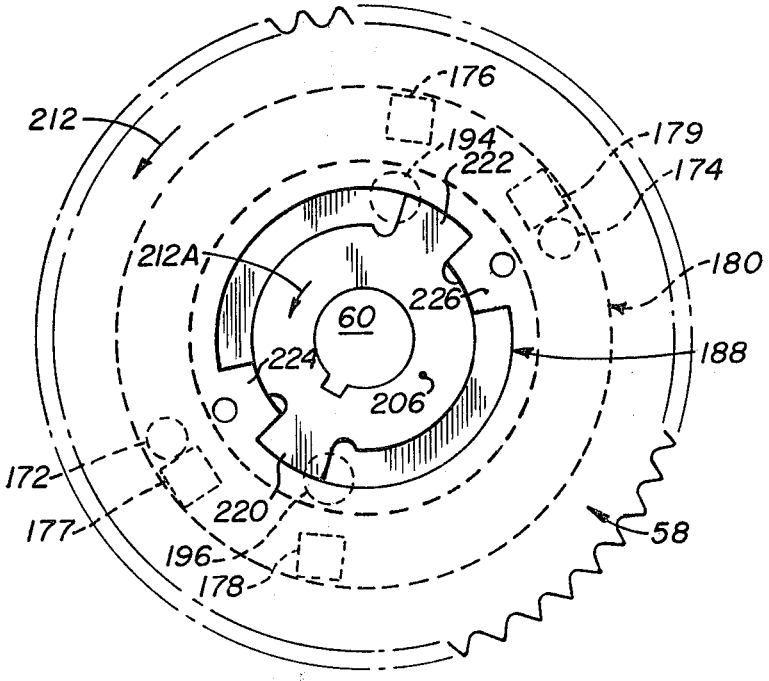
FIG. 12 is a schematic view similar to FIG. 10 showing the relative relation of the brake components in a brake released position.
Figure 13:
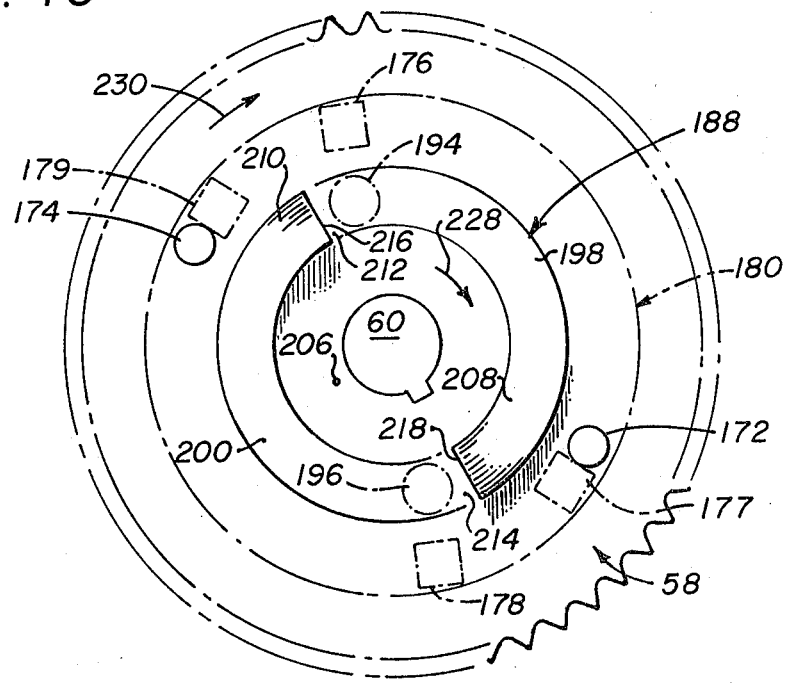
FIG. 13 is a view of the components of FIG. 12 in a position identical to FIG. 12 but showing the reverse side of those brake components.

Drive sprocket 58 and brake cam 188 continue to move counterclockwise as shown by arrows 212, 212A in FIG. 10 in synchronism relative to brake disc 180. This movement as best seen in FIG. 11 causes profiled brake cam surfaces 198, 200 to be driven in the direction of arrow 228 in FIG. 11 under brake disc pressure pins 194, 196 from an "up ramp" condition (FIG. 11) to a "down ramp" condition (FIG. 13). Simultaneously with such movement, a second lost motion drive, comprising drive sprocket pin 172 and brake disc stud pair 176, 177 (and pin 174 and brake disc stud pair 178, 179), is rendered temporarily inoperative with pins 172, 174 being moved toward a cable power-in drive engaged, brake released position (FIGS. 12 and 13).

In such brake released position wherein a power-in drive is applied to the loaded cable drum 12 (FIGS. 12 and 13), the second lost motion drive is re-engaged upon sprocket pins 172 and 174 respectively engaging brake disc studs 177 and 179, and the low ramp ends 212, 214 of cam surfaces 198, 200 respectively rotate in the direction of arrow 228 in FIG. 13 into position under brake disc pressure pins 194 and 196 (FIG. 13). Under this condition (with the power-in drive engaged under cable load and brake assembly 104 released), the drive sprocket 58, brake cam 188 and brake disc 180 rotate in unison in a counterclockwise direction viewed axially from outside drive sprocket 58 (in the direction of arrow 212 in FIGS. 10 and 12 and arrow 230 in FIGS. 11 and 13) to wind cable 20 about drum 12 in its power-in mode.

By virtue of the above-described construction, brake assembly 104 with motor 28 "on" in its power-in cable loaded mode effects automatic brake release, albeit any load on cable 20 tends to rotate brake cam 188 clockwise (in a direction opposite arrow 212A in FIGS. 10 and 12) via the cycloid drive 42 between cable drum and brake cam 188. I.e., once rotation of drive sporcket 58 results in engagement of its lugs 224, 226 with brake cam lugs 220, 222 (first lost motion drive engaged) and thereafter upon engagement of the drive sprocket pins 172, 174 with studs 177, 179 (second lost motion drive engaged), the sprocket 58, brake cam 188 and disc 180 rotate counterclockwise in unison in a winch "power-in" mode with brake assembly 104 released, against the force of the cable load urgine brake cam 188 in a direction opposite its power-in direction of rotation.

Moreover, were cable 20 to become slack or were it to lose tension for any reason with motor 28 "on" and winch 10 operating in a power-in cable loaded mode, no free wheeling of cable drum 2 will be encountered, for drive sprocket lugs 224, 226 and brake cam lugs 220, 222 will be continuously engaged and will prevent undesired free wheeling cable payoff from drum 12.

Also, were power interrupted to drive sprocket 58 for any reason such as failure of the double stage roller chain sprocket drive from motor 28, for example, or simply upon turning motor 28 "off" with cable 12 under load, brake cam 188 will automatically be driven clockwise by any load on cable 20 (which load tends to unwind cable 20 in a counterclockwise direction of movement of drum 12) and effect reverse unitary movement of drive shaft 60 and brake cam 188 via the cycloid drive 42 in an angular direction opposite that shown by arrows 212, 212A in FIG. 12 and arrows 230, 228 in FIG. 13 illustrating the brake released, drive engaged mode of winch operation. Accordingly, with no power applied to drive sprocket 58, brake disc 180 will remain relatively stationary and reverse rotation of brake cam 188 in an angular direction opposite arrows 212A and 228 of FIGS. 12 and 13 drives cam ramp surfaces 198, 200 on brake cam 188 "up ramp" over brake disc pressure pins 194, 196. Such action imposes an axially directed force to brake disc 180 urging it into locking engagement with anchor plate brake pads 192. Thereupon, drive shaft eccentric 120 and brake cam 188 are locked against rotation by virtue of the high ramp ends 208, 210 of cam surfaces 198, 200 engaging pressure pins 194, 196 respectively and pressing brake disc 180 axially of its drive shaft 60 into locking engagement with anchor plate brake pads 192.

Accordingly, when cable drum 12 is under load and whenever motor 28 is "off", brake assembly 104 automatically engages to effect a load compensating braking action.

Some length of cable 12 may payout a limited extent under cable loading upon motor shut-off from a cable power-in mode. Such limited cable payout would correspond to that permitted by a counterclockwise return (as viewed in FIG. 1) of the cycloid drive 42 under cable load to re-engage the right hand ring gear lobe 144 against lock pin 134.

Upon shutting "off" motor 28 and its consequent unloading and cranking down under cable loaded power-in conditions, the brake assembly 104 engages causing the motor 28 to reverse. Its reverse motor inertia is absorbed by a pair of drag springs 234, 236 (FIGS. 2 and 9) shown disposed in openings in drive sprocket 58 with opposite ends of springs 234, 236 respectively seated against flat retaining washer 102 and brake cam 188 to continuously effect a biasing drag on the brake cam. By virtue of this disclosed drag spring arrangement, undesired drive sprocket rotation and engagement of its lugs 224, 226 with the brake cam lugs 220, 222 is prevented to minimize unintended brake unlocking.

When motor 28 is energized with lock pin 134 engaged in a "power-out" cable loaded mode to power rotate drum 12 counterclockwise as viewed axially from outside its drive sprocket 58 (FIG. 1), motor output shaft 36 rotates clockwise and drives the dirve sprocket 58 through the double stage roller chain sprocket drive in a corresponding clockwise direction (in an angular direction opposite arrows 212 and 230 in FIGS. 10 and 11). The relative spacing among components of the first and second lost motion drives is such that drive sprocket pins 172, 174 initially engage brake disc studs 176, 178 to drive brake disc pressure pins 194, 196 "down ramp" relative to cam ramp surfaces 198, 200 of brake cam 188 (FIG. 11) to increasingly relieve the effective braking forces on the cable drum drive before any engagement between drive sprocket lugs 224, 226 and brake cam lugs 220, 222, comprising the above described first lost motion drive, is effected by following brake cam movement under cable loading. With sprocket 58 being driven faster than the cable load is driving brake cam 188, the brake assembly 104 is disengaged. As described, brake cam 188 under cable load is continuously urged to automatically rotate clockwise (FIG. 10) due to the cable load urging drum 12 counterclockwise. Continued clockwise rotation of drive sprocket 58 (as viewed axially from the outside of drive sprocket in FIG. 1) under motor power in a power-out cable loaded mode again results in a load compensating braking action to virtually eliminate any undesired escalating payout cable speeds under load.

The disclosed construction effects such load compensating brake action since brake cam 188 under cable loaded condition tends to rotate clockwise (FIG. 10) through an angular displacement provided by any gap between the rotating drive sprocket internal lugs 224, 226 and brake cam external lugs 220, 222 when the cable load effects a faster clockwise rotation of brake cam 188 than that imposed by drive sprocket 58 on brake disc 180 to drive brake cam surfaces 198 and 200 "up ramp" (FIG. 11) under brake disc pressure pins 194 and 196.

Such action by brake cam 188 accordingly serves as a governor to automatically apply braking forces to winch 10 whereby continued motor powered clockwise rotation of drive sprocket rotates brake disc 180 clockwise with increased loading on cable 20 effecting faster clockwise movement of brake cam 188 in following relation to drive sprocket 58 in turn to provide a slower, more controlled cable payout. Once power is shut off to drive sprocket 58, for whatever reason, the cable load automatically effects lock-up of brake assembly 104 via cycloid drive 42 which rotates brake cam 188 clockwise into brake engaged position.

Under cable loaded power-out mode, no gap is effected between right hand ring gear lobe 144 and lock pin 134 (normally engaged as viewed in FIG. 1 under motor "off", static cable loaded conditions), for upon initial clockwise rotation of drive shaft eccentric 120 in power-out mode both cycloid gear 110 and ring gear 98 are initially urged counterclockwise to maintain ring gear lobe 144 and lock pin 134 in engagement to fix ring gear 98 relative to cycloid gear 110. Upon arrest of drive shaft eccentric 120 in power-out mode by operation of brake assembly 104 upon motor shut-off, no relative motion between lock pin 134 and ring gear 98 occurs since cable loading maintains the same in normally engaged position.

If it is desired to effect free spooling to pull out cable 20 without powering it out, lock pin 134 may be removed from its full line position (FIG. 4) to permit ring gear 98 to rotate relative to anchor plate 68. To prevent undesired cable snarling due to conventional drum coasting, such free spooling automatically activates a drag spring braking unit 238 (FIG. 2) whereby a drag brake button 240, preferably of nylon or similar self-lubricating material, received in a pocket 242 in anchor plate 68, is biased by a suitable spring 244 into engagement with a confronting face of ring gear 98. A plurality of such drag spring braking units such as 238 may be provided. It has been found that two such units diametrically spaced apart have been effective to insure snarl-free controlled free spooling. Moreover, "no penalty" loading is achieved during normal winching operations with the lock pin 134 engaged, for ring gear 98 under such conditions is effectively stationary as previously described.

As will be apparent to persons skilled in the art, various modifications, adaptations and variations of the foregoing specific disclosure can be made without departing from the teachings of the present invention.

I claim:

1. A winch drive mechanism comprising a cable drum, a housing including an anchor plate having a circular hub in coaxial alignment with the cable drum, a bearing assembly mounted within the anchor plate hub, a selectively reversible, powered input drive shaft rotatably supported within the bearing assembly in coaxial alignment with the cable drum and having an eccentric fixed to the drive shaft, a speed change reducer connecting the drive shaft and cable drum including a ring gear supported for rotation on the anchor plate hub in coaxial relation to the drive shaft and a cycloid gear in meshing engagement with the ring gear, the cycloid gear being supported on the drive shaft eccentric for eccentric movement thereon within the ring gear for rotating the cable drum responsive to rotation of the drive shaft, a removable clutch pin for releasably interlocking the ring gear and housing in fixed relation, the ring gear including a plurality of peripheral lobes extending radially outwardly for engagement with the clutch pin, the ring gear being freely rotatable about the anchor plate hub upon removal of the clutch pin.

2. The drive mechanism of claim 1 wherein a drag brake is provided between the ring gear and the housing for controlling cable payoff from the cable drum upon free spooling of the drum when the clutch pin is removed to release the ring gear for free rotation relative to the housing.

3. A winch drive mechanism comprising a housing, a cable drum rotatably supported on the housing, the housing including an anchor plate having an axially projecting circular hub in coaxial alignment with the cable drum, a selectively reversible, powered input drive shaft rotatably supported on the housing coaxially with the cable drum and having an eccentric fixed to the drive shaft, a ball bearing assembly mounted within the anchor plate hub for rotatably supporting the drive shaft and having outer and inner races respectively secured to the anchor plate and drive shaft, a single stage speed change reducer connecting the drive shaft and cable drum including a ring gear supported for rotation on the anchor plate hub in coaxial relation to the drive shaft and a cycloid gear in meshing engagement with the ring gear, the cycloid gear being supported on the drive shaft eccentric for eccentric movement thereon within the ring gear for rotating the cable drum responsive to rotation of the drive shaft, and a removable clutch pin for releasably interlocking the ring gear and housing in fixed relation.

4. The drive mechanism of claim 3 wherein retaining means is mounted on the anchor plate hub for maintaining the ring gear against axial displacement relative to the hub, wherein the anchor plate hub includes a cavity containing a drag brake button and a spring seated in the cavity continuously urging the button into engagement with a confronting surface of the ring gear for effecting frictional resistance to relative movement of the ring gear and anchor plate, wherein the housing includes an opening therein providing a clutch pin receiving chamber formed with a relatively enlarged detent recess, wherein the clutch pin includes a detent engageable within the housing recess for releasably securing the clutch pin in an operating position within the chamber, the clutch pin and housing chamber being relatively dimensioned such that the clutch pin in its operating position projects beyond the housing chamber for locking engagement with the ring gear, wherein the clutch pin detent is resiliently biased into seating engagement within the recess for releasably retaining the clutch pin in its operating position for securing the ring gear against rotation relative to the housing and anchor plate, the ring gear being rotatable relative to the housing and anchor plate upon clutch pin removal from its said operating position.

5. A winch drive mechanism comprising a housing, a cable drum rotatably supported on the housing, a selectively reversible, powered input drive shaft rotatably supported on the housing coaxially with the cable drum and having a eccentric fixed to the drive shaft, a single stage speed change reducer connecting the drive shaft and cable drum including a ring gear supported for rotation relative to the housing in coaxial relation to the drive shaft and a cycloid gear in meshing engagement with the ring gear, the cycloid gear being supported on the drive shaft eccentric for eccentric movement thereon within the ring gear for rotating the cable drum responsive to rotation of the drive shaft, and a removable clutch pin for releasably interlocking the ring gear and housing in fixed relation, the ring gear including a plurality of peripheral lobes extending radially outwardly for engagement with the clutch pin.

6. A winch drive mechanism comprising a housing, a cable drum rotatably supported on the housing, a selectively reversible, powered input drive shaft rotatably supported on the housing coaxially with the cable drum and having an eccentric fixed to the drive shaft, a single stage speed change reducer connecting the drive shaft and cable drum including a ring gear supported for rotation relative to the housing in coaxial relation to the drive shaft and a cycloid gear in meshing engagement with the ring gear, the cycloid gear being supported on the drive shaft eccentric for eccentric movement thereon with the ring gear for rotating the cable drum responsive to rotation of the drive shaft, a removable clutch pin for releasably interlocking the ring gear and housing in fixed relation, a drag brake between the ring gear and the housing for controlling cable payoff from the cable drum upon free spooling of the drum when the clutch pin is removed to release the ring gear for free rotation relative to the housing, the drag brake including a braking button mounted in a cavity formed in one of the ring gear and housing members, the cavity including a spring seated in the cavity and continuously biasing the braking button into engagement with the other of the ring gear and housing members for effecting frictional resistance to ring gear rotation relative to the housing upon clutch pin removal for controlled cable payoff relative to the drum.

7. A winch drive mechanism comprising a housing, a cable drum rotatably supported on the housing, a selectively reversible, powered input drive shaft rotatably supported on the housing coaxially with the cable drum and having an eccentric fixed to the drive shaft, a single stage speed change reducer connecting the drive shaft and cable drum including a ring gear supported for rotation relative to the housing in coaxial relation to the drive shaft and a cycloid gear in meshing engagement with the ring gear, the cycloid gear being supported on the drive shaft eccentric for eccentric movement thereon within the ring gear for rotating the cable drum responsive to rotation of the drive shaft, a cycloid hub fixed to the cable drum in coaxial alignment therewith, the cycloid hub having a plurality of drive pins fixed thereon in parallel relation to the drive shaft axis, the hub drive pins being equally spaced apart equidistant from the axis of the hub, the cycloid gear having pin receiving openings therein corresponding to the hub drive pins for drivingly connecting the input drive shaft and cable drum for rotation respectively in opposite angular directions, a roller mounted for free rotation about each drive pin, the rollers each being engageable with the cycloid gear surface surrounding its respective opening, a support ring mounted on the cycloid gear and having apertures in the support ring for receiving projecting terminal ends of the drive pins projecting through the cycloid gear, retaining means for securing the support ring and the drive pins in fixed operative relation to one another, and a removable clutch pin for releasably interlocking the ring gear and housing in fixed relation.

8. A winch drive mechanism comprising a housing, a cable drum rotatably supported on the housing, a selectively reversible, powered input drive shaft rotatably supported on the housing coaxially with the cable drum and having an eccentric fixed to the drive shaft, a single stage speed change reducer connecting the drive shaft and cable drum including a ring gear supported for rotation relative to the housing in coaxial relation to the drive shaft and a cycloid gear in meshing engagement with the ring gear, the cycloid gear being supported on the drive shaft eccentric for eccentric movement thereon within the ring gear for rotating the cable drum responsive to rotation of the drive shaft, a removable clutch pin for releasably interlocking the ring gear and housing in fixed relation, a locking recess being formed in the housing, a locking detent being mounted in the clutch pin, the clutch pin including a manually operated actuating rod coaxially mounted therein, a spring urging the rod into a normal position wherein the rod and spring cooperate to bias the detent into seating engagement within the recess for releasably retaining the clutch pin in an operating position for interlocking engagement with the housing and ring gear, the rod having a camming surface formed thereon and an adjacent reduced diameter rod portion registrable with the detent upon movement of the rod relative to the clutch pin against the biasing force of the spring, the camming surface and reduced diameter rod portion cooperating with the locking detent upon engagement therewith responsive to movement of the rod relative to the pin to permit release and re-engagement of the clutch pin in its operating position within the housing upon opposite relative axial movements of the rod relative to the clutch pin.

* * * * *